United States Patent [19]

Thawley et al.

[11] Patent Number: 4,468,665

[45] Date of Patent: Aug. 28, 1984

[54] DOWNHOLE DIGITAL POWER AMPLIFIER FOR A MEASUREMENTS-WHILE-DRILLING TELEMETRY SYSTEM

[75] Inventors: S. Tom Thawley; Craig M. Scott, both of Dallas, Tex.

[73] Assignee: Tele-Drill, Inc., Richardson, Tex.

[21] Appl. No.: 229,799

[22] Filed: Jan. 30, 1981

[51] Int. Cl.[3] ..... G01V 1/40

[52] U.S. Cl. ..... 340/856; 367/76; 33/312

[58] Field of Search ..... 367/65-67, 367/76; 455/4; 330/279, 129; 33/312; 340/825, 856

[56] References Cited

U.S. PATENT DOCUMENTS

| | | | |
|---|---|---|---|
| 3,360,738 | 12/1967 | Harris et al. | 367/65 |
| 3,732,728 | 5/1973 | Fitzpatrick | 340/854 |
| 3,938,129 | 2/1976 | Smithes | 340/856 |
| 4,087,781 | 5/1978 | Grossi et al. | 340/854 |
| 4,136,327 | 1/1979 | Flanders et al. | 340/856 |
| 4,218,678 | 8/1980 | Fowler et al. | 343/5 GT |

FOREIGN PATENT DOCUMENTS

| | | | |
|---|---|---|---|
| 2040125 | 8/1980 | United Kingdom | 367/67 |
| 314171 | 11/1971 | U.S.S.R. | 367/65 |

*Primary Examiner*—Nelson Moskowitz

*Attorney, Agent, or Firm*—John J. Byrne; Bradford E. Kile

[57] ABSTRACT

A downhole digital power amplifier comprises a device which, through digital means, provides a sinusoidal, variable frequency, variable power and variably phase-shift modulated output for the transmission of data from a downhole sensor arrangement to an uphole receiver. Selection and variation of frequency, power and modulation are made through digital inputs. The device provides these functions at extra low frequencies (ELF) low-to-high power output, and varying phase-shift keying. The downhole digital power amplifier (68) comprises, in a preferred embodiment, an input shift register (81) for receiving a digital bit stream, a programmable frequency divider (82), a dead man timer circuit (84), a counter (86), a sync circuit (88), a PROM (90) (programmable read-only memory) for generating a digital sinusoidal output, a DAC (92) (digital-to-analog converter) for converting the digital sinusoidal output to an analog sinusoidal output, a power supply control circuit (94), an analog divider (96), and a conventional power amplifier (98). The dead man timer circuit detects normal operation and a fault condition, and controls the power supply control circuit to "power down" the amplifier when reception of a digital bit stream is not imminent during normal operation, and controls the power supply control circuit to periodically generate a "failure informant" message during a fault condition.

18 Claims, 8 Drawing Figures

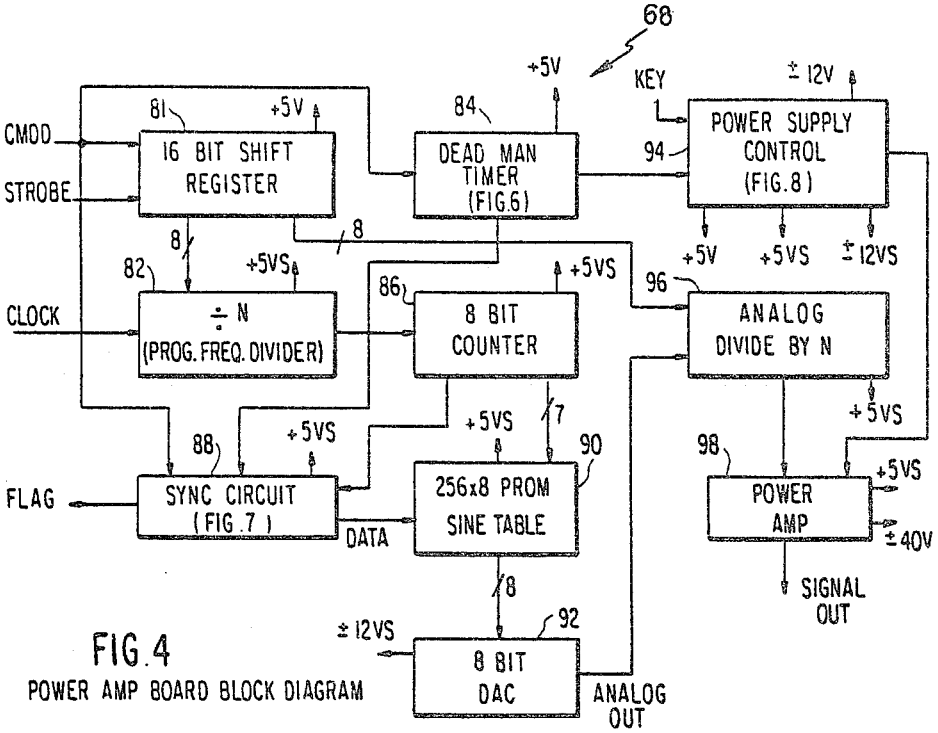
FIG.4
POWER AMP BOARD BLOCK DIAGRAM
FIG.6
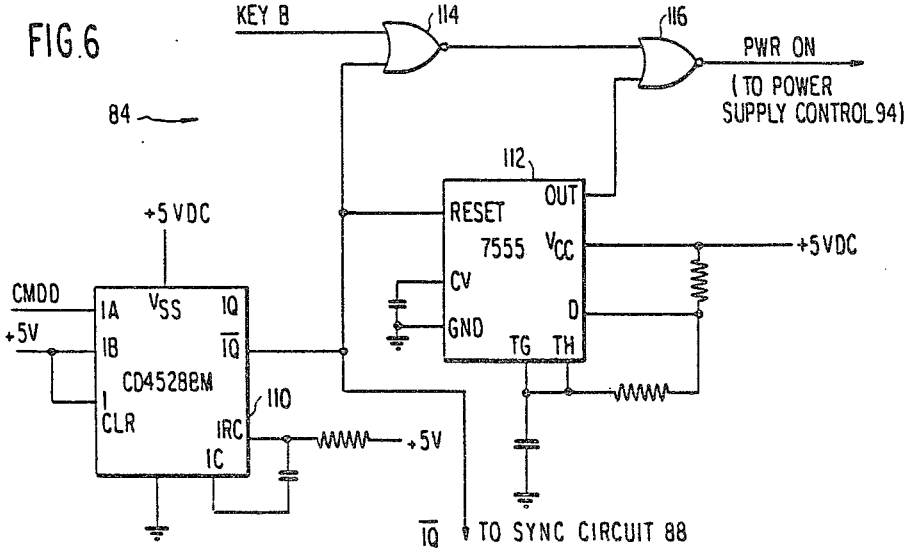

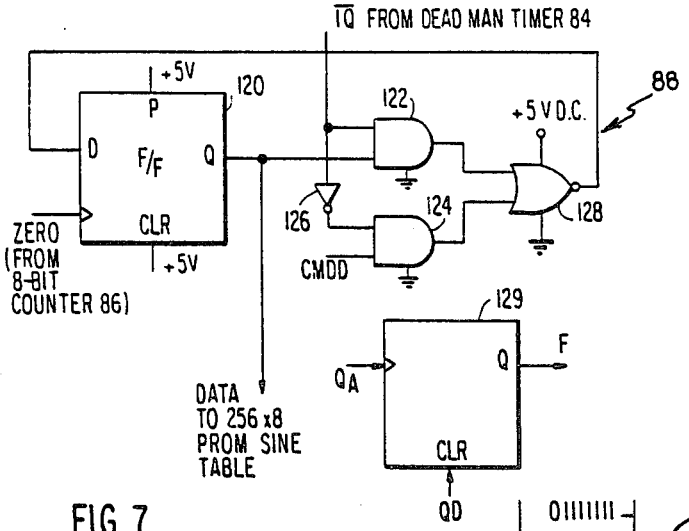
FIG. 7
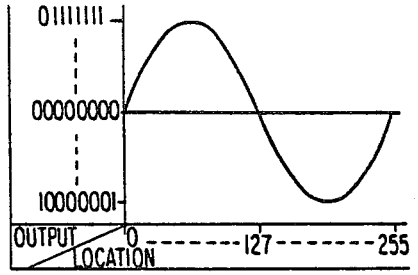
FIG. 5
SINE TABLE PROM CONTENTS
FIG. 8
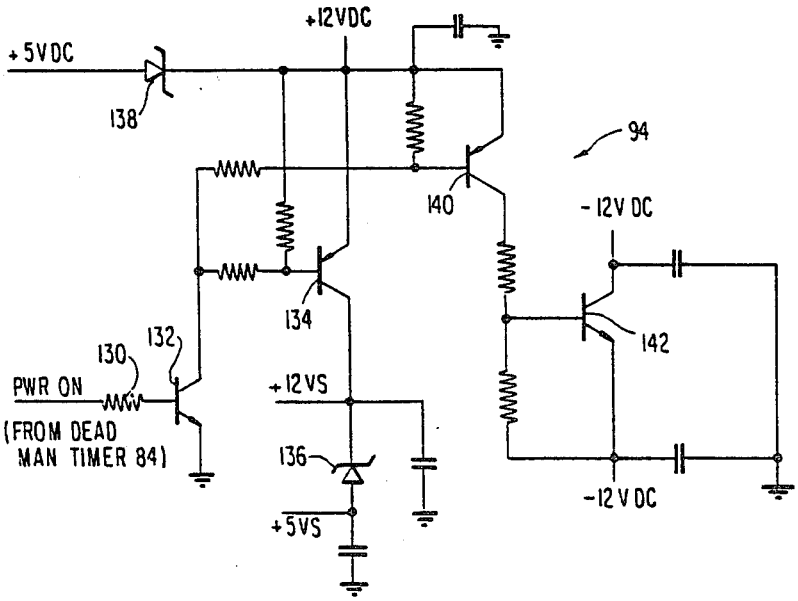

DOWNHOLE DIGITAL POWER AMPLIFIER FOR A MEASUREMENTS-WHILE-DRILLING TELEMETRY SYSTEM

BACKGROUND OF THE INVENTION

1. Field of the Invention

This invention relates to a downhole digital power amplifier, and more specifically a device which, through digital means, provides a sinusoidal, variable frequency, variable power and phase-shift modulated output for the transmission of data from a downhole sensor arrangement to a coupling transfer device, or the like. Selection of and variation for frequency, power and modulation are made by digital inputs, and the device provides these functions at extra low frequencies (ELF), low-to-high power output, and varying phase-shift keying. Although the subject invention has a range of applications, the invention has particular utility as a downhole digital power amplifier for use in a measurements-while-drilling (MWD) system.

The incentives for downhole measurements during drilling operations are substantial. Downhole measurements while drilling will allow safer, more efficient, and more economic drilling of both exploration and production wells.

Continuous monitoring of downhole conditions will allow immediate response to potential well-control problems. This will allow better mud programs and more accurate selection of casing seats, possibly eliminating the need for an intermediate casing string, or a liner. It also will eliminate costly drilling interruptions while circulating to look for hydrocarbon shows at drilling breaks, or while logs are run to try to predict abnormal pressure zones.

Drilling will be faster and cheaper as a result of real-time measurement of parameters such as bit weight, torque, wear and bearing condition. The faster penetration rate, better trip planning, reduced equipment failures, delays for directional surveys, and elimination of a need to interrupt drilling for abnormal pressure detection, could lead to a 5 to 15% improvement in overall drilling rate.

In addition, downhole measurements while drilling may reduce costs for consumables, such as drilling fluids and bits, and may even help avoid setting pipe too early. Were MWD to allow elimination of a single string of casing, further savings could be achieved since smaller holes could be drilled to reach the objective horizon. Since the time for drilling a well could be substantially reduced, more wells per year could be drilled with available rigs. The savings described would be free capital for further exploration and development of energy resources.

Knowledge of subsurface formations will be improved. Downhole measurements while drilling will allow more accurate selection of zones for coring, and pertinent information on formations will be obtained while the formation is freshly penetrated and least affected by the mud filtrate. Furthermore, decisions regarding completing and testing a well can be made sooner and more competently.

There are two principal functions to be performed by a continuous MWD system: (1) downhole measurements, and (2) data transmission. The subject invention pertains to an element in the data transmission aspect of MWD.

2. Description of Prior Art

The transmission of data or other information from downhole sensors or telemetry systems has typically incorporated such techniques as (1) mud-pressure pulse, (2) insulated conductor, (3) acoustic generation, and (4) electromagnetic waves. These techniques utilize an analog input and analog circuitry to provide the desired frequency, power and modulation outputs. The use of analog devices and techniques has proven in the past to be bulky and relatively inaccurate, particularly at extra low frequencies and high power. Because of this, transmission rates and frequencies are normally set at a single value.

In a mud-pressure pulse system, the resistance to the flow of mud through a drill string is modulated by means of a valve and control mechanism mounted in a special drill-collar sub near the bit. The communication speed is fast since the pressure pulse travels up the mud column at or near the velocity of sound in the mud, or about 4,000 to 5,000 fps. However, the rate of transmission of measurements is relatively slow due to pulse spreading, modulation-rate limitations, and other disruptive limitations such as the requirement of transmitting data in a fairly noisy environment.

Insulated conductors, or hard-wire connection from the bit to the surface, is an alternative method for establishing downhole communications. The advantages of wire or cable systems are that: (1) capability of a high data transmission rate is provided; (2) power can be sent downhole; and (3) two-way communication is possible. This type of system has at least two disadvantages; it requires a special drill pipe, and it requires special tool-joint connectors.

To overcome these disadvantages, a method of running an electrical connector and cable to mate with sensors in a drill-collar sub was devised. The trade-off or disadvantage of this arrangement is the need to withdraw the cable, then replace it each time a joint of drill pipe is added to the drill string. In this and similar systems the insulated conductor is prone to failure as a result of the abrasive conditions of the mud system and the wear caused by the rotation of the drill string. Also, cable techniques usually entail awkward handling problems, especially during adding or removing joints of drill pipe.

In addition, hardwire systems use high frequencies which utilize smaller components to circumvent size problems downhole. While the data rate is higher, the number of analog components required is great. In addition, in acoustic-type systems, an acoustic (or seismic) generator is located near the bit. Acoustic methods use the higher frequencies which are not only affected by acoustic noise during drilling, but also by higher signal attenuation through the conducting media. Accordingly, it is considered highly desirable to develop a transmitter which will occupy a small area, generate frequency in the ELF range at high power, and yet be capable of modulating data at a moderate rate with comparatively low loss. Power for this generator would have to be supplied downhole. The very low intensity of the signal which can be generated downhole, along with the acoustic noise generated by the drilling system, make signal detection difficult. Reflective and refractive interference resulting from changing diameters and thread makeup at the tool joints compound the signal attenuation problem for drill-pipe transmission. Moreover signal-to-noise limitations for each acoustic transmission path are not well defined.

Finally, the last major previously known technique comprises the transmission of electromagnetic waves through a drill pipe and the earth. In this connection electromagnetic pulses carrying downhole data are input to a toroid positioned adjacent a drill bit. A primary winding, carrying the data for transmission, is wrapped around the toroid and a secondary is provided by the drill pipe. A receiver is connected to the ground at the surface and the electromagnetic data is picked up and recorded at the surface.

Downhole arrangements and devices known in the prior art are typified by Zill et al—U.S. Pat. Nos. 3,618,001 and 3,750,098 which disclose a downhole acoustic logging control system, wherein a single channel is arranged to provide at least two degrees of amplification of electrical signals in a sequence synchronized with transmissions of acoustic energy from the transmitter. In such an arrangement, control of gain selection originates in the downhole device, and there are no digital commands. More specifically, as shown in FIG. 3 of the aforementioned patents, a mechanical gain select relay and associated mechanical contacts are controlled, via a mode control unit, by a sequence counter. In such an arrangement, the varying degrees of amplification of the variable gain amplifier may only be chosen in a fixed sequence (for example, low, medium, high gain). Thus, such an arrangement is burdened by the disadvantages of inflexibility in designating a particular gain value (as is accomplished, for example, by the use of a digital command).

Another arrangement in the prior art is disclosed in Baldwin et al—U.S. Pat. No. 3,518,679. That patent discloses a well logging system employing a three-conductor logging cable for transmitting signals and power between the surface and an acoustic logging tool. As seen in the patent, the downhole arrangement has an amplifier and gain control system controlled from the surface by a switch system so as to switch gain values between certain predesignated values. The disclosed arrangement also includes a downhole switch controlled by an uphole switch for selecting an orienting output signal of the circuit or a rotating switch signal of the circuit in the downhole device, such signals being selected for transmission to the surface. It is to be emphasized that only certain gain values may be selected by connecting a switch line to respective contacts under the influence of a solenoid. Thus, the arrangement of the subject patent is again burdened by the disadvantages of lack of flexibility and lack of capability of designating precisely the particular gain value selected.

SUMMARY OF INVENTION

The present invention relates to a downhole digital power amplifier, and more specifically a device which, through digital means, provides a sinusoidal, variable frequency, variable power and phase-shift modulated output for the transmission of data from a sensor arrangement to a coupling transfer device. Selection of and variation for frequency, power and modulation are made through digital inputs, and the device provides these functions at ELF, low-to-high power output, and varying phase-shift keying.

More specifically, the inventive downhole digital power amplifier receives inputs necessary for proper operation from a serial data stream generated by a microprocessor-controlled shift register located some distance from the amplifier (in the preferred embodiment, in an electronics package located in the drill string). The amplifier of the present invention is primarily digital, and yet it is capable of producing a sinusoidal output at a selected frequency, power and modulation. The amplifier also provides a "failure informant" capability which, upon detection of a discrepancy in operation, causes a preset code to be transmitted periodically, thus informing the uphole system and personnel at the surface of a "fault condition" in the downhole electronics. In addition, in accordance with the present invention, the downhole digital power amplifier is capable, upon digital command, of changing its frequency over a range from 0.2 Hz to 100 Hz., its power over a range from 400 mw. to 100 watts, and its modulation phase-shift over a range from 0° to 180°.

OBJECTS OF THE INVENTION

It is, therefore, an object of the present invention to provide a downhole digital power amplifier for use in a measurements-while-drilling telemetry system.

It is an additional object of the present invention to provide a downhole digital power amplifier which, via digital means, provides a sinusoidal, variable frequency, variable power and phase-shift modulated output for the transmission of data from a sensor arrangement to a coupling transfer device, for ultimate transmission uphole to the surface.

It is an additional object of the present invention to provide a downhole digital power amplifier having the capability of selection of and variation for frequency, power and modulation through the use of digital inputs or commands.

It is an additional object of the present invention to provide a downhole digital power amplifier which provides the above-mentioned functions at extra low frequencies (ELF), low-to-high power output, and varying phase-shift keying.

It is an additional object of the present invention to provide a downhole digital power amplifier having a "failure informant" capability.

THE DRAWINGS

Other objects and advantages of the present invention will become apparent from the following detailed description of preferred embodiments thereof taken in conjunction with the accompanying drawings, wherein:

FIG. 4 is a block diagram of the downhole digital power amplifier contained within the downhole electronics system shown in FIG. 2.

FIG. 5 is a sinusoidal waveform used to describe the operation of the sine table PROM contained within the downhole digital power amplifier of the present invention.

FIG. 6 is a schematic of the dead man timer in the downhole digital power amplifier of the present invention.

FIG. 7 is a schematic of the sync circuit in the downhole digital power amplifier of the present invention.

FIG. 8 is a schematic of the power supply control circuit in the downhole digital power amplifier of the present invention.

DETAILED DESCRIPTION

Figure 1:
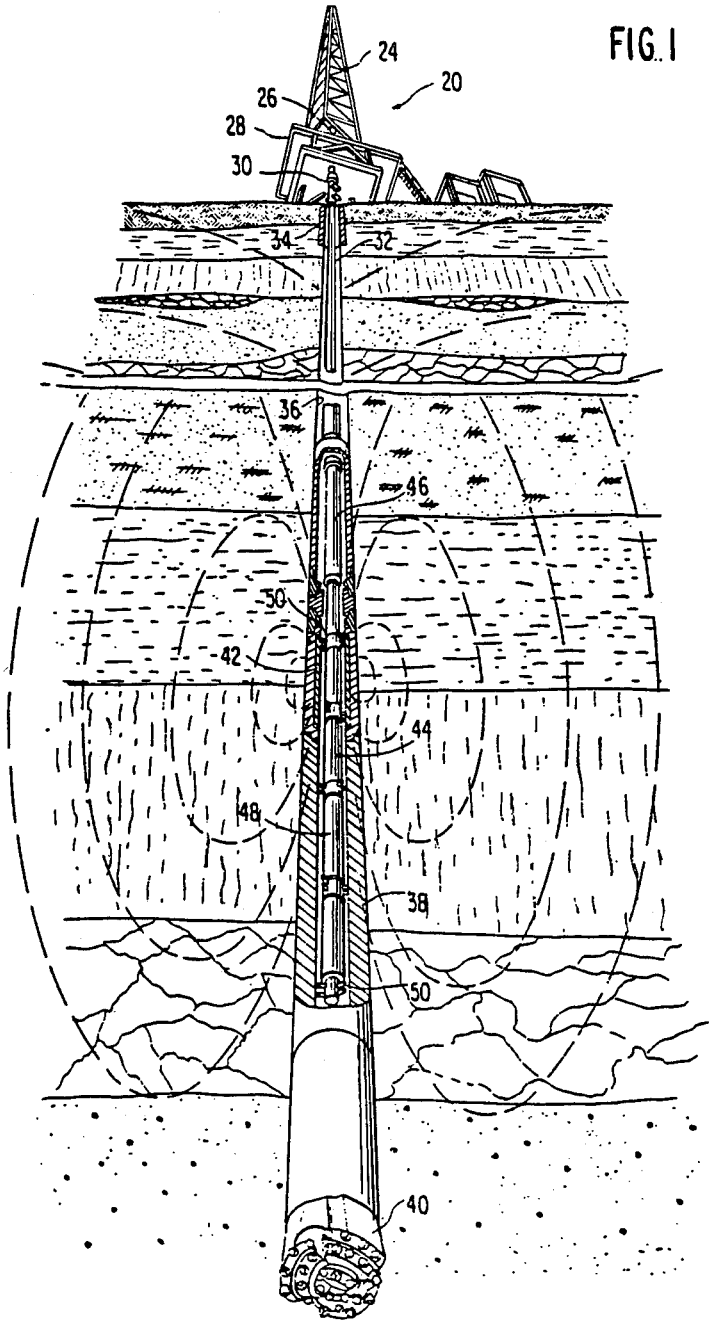
FIG. 1 is a perspective view from the end of a drill string disclosing a drill collar and a toroidal coupled MWD system for continuously telemetering real time data to the surface.

Referring now to the drawings, wherein the numerals indicate like parts, there will be seen various general views of a toroidal coupled, MWD telementary system in which the subject invention has particular application and detail views of preferred embodiments of electrical isolation and structural assemblies in accordance with the subject invention.

Context of the Invention

Before providing a detailed description of the subject structural assemblies it may be worthwhile to outline the operating context of the invention. In this connection and with reference to FIG. 1, there will be seen a conventional rotary rig 20 positioned to drill a bore hole 22 through variant earth strata. The rotary rig 20 includes a mast 24 of the type operable to support a traveling block 26 and various hoisting equipment. The mast is supported upon a substructure which straddles annular and ram blowout preventors 30. Drill pipe 32 is lowered from the rig through surface casing 34 and into a bore hole 36. The drill pipe 32 extends through the bore hole to a drill collar 38 which is fitted at its distal end with a conventional drill bit 40 which is rotated and penetrates through the earth strata.

The drill collar 38 provides weight on the drill bit 40 to facilitate penetration. Such drill collars typically are composed of thick side walls and are subject to severe tension, compression, torsion and column bending loads. In the subject system, the drill collar further serves to house a data transmit toroid 42 comprising a core for the windings of a downhole data telemetering system. Finally, the subject drill collar 38 also functions as a support to hang a concentrically suspended telemetering tool 44 operable to detect and transmit downhole data to the surface concomitantly with normal operation of the drilling equipment.

The telemetering tool 44 is composed of a number of sections in series. More specifically, a battery pack 46 is followed by a sensing and data electronics transmission section 48 which is concentrically maintained and electrically isolated from the interior of the drill collar 38 by a plurality of radially extending fingers 50 composed of a resilient dielectric material.

Figure 2:
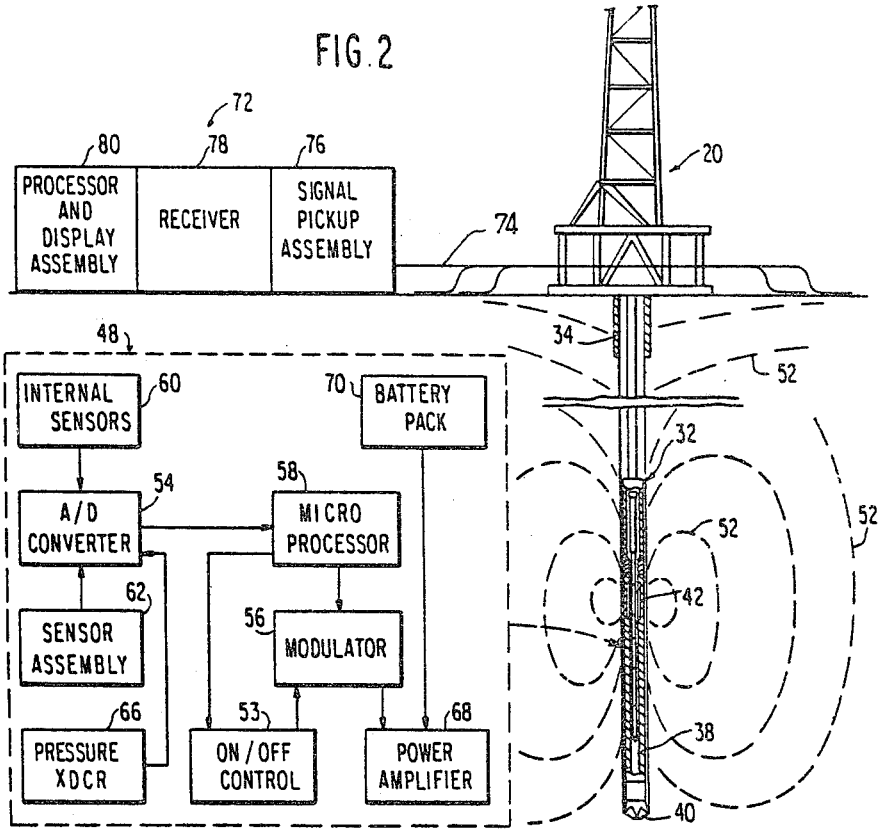
FIG. 2 is a schematic view of the MWD telemetering system including a block diagram of a downhole electronic system which is structurally internal to the drill collar and an uphole signal pickup system.
Figure 3:
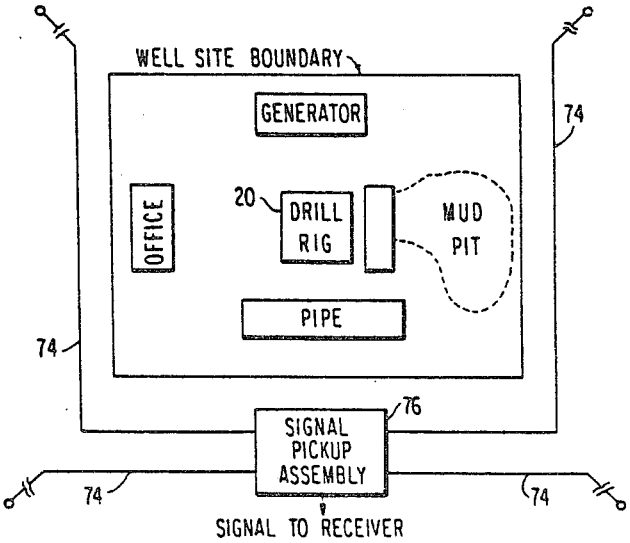
FIG. 3 is a plan view of the uphole system for picking up MWD data signals.

Turning now to FIGS. 2 and 3, there will be seen system diagrams for a toroidal-coupled MWD telemetry system. In this system, drill bit, environmental and/or formation data is supplied to the tool data electronics sections 48. This section includes an on/off control 53, and A/D converter 54, a modulator 56 and a microprocessor 58. A variety of sensors 60, 62, etc. located throughout the drill string supply data to the electronics section 48.

Upon receipt of a pressure pulse command via transducer 66, or expiration of time-out unit, whichever is selected, the electronics unit will power up, obtain the latest data from the sensors, and begin transmitting the data to a power amplifier 68.

The electronics unit and power amplifier are powered from nickel cadmium batteries 70 which are configured to provide proper operating voltage and current.

Operational data from the electronics unit is sent to the downhole digital power amplifier 68 which establishes the frequency power and phase output of the data. The data is then shifted into the power amplifier 68. The amplifier output is coupled to the data transmit toroid 42 which electrically approximates a large transformer wherein the drill string 32 is the secondary.

The signals launched from the toroid 42 are in the form of electromagnetic wave fronts 52 traveling through the earth. These waves eventually penetrate the earth's surface and are picked up by an uphole system 72.

The uphole system 72 comprises radially extending receiving arms 74 of electrical conductors. These conductors are laid directly upon the ground surface and may extend three or four hundred feet away from the drill site. Although the generally radial receiving arms 74 are located around the drilling platform, as seen in FIG. 3, they are not in electrical contact with the platform or drill rig 20.

The radial receiving arms 74 intercept the electromagnetic wave fronts 52 and feed the corresponding signals to a signal pickup assembly 76 which filters and cancels extraneous noise which has been picked up, amplifies the corresponding signals and sends them to a low level receiver 78.

A processor and display system 80 receives the raw data output from the receiver, performs any necessary calculations and error corrections and displays the data in a usable format.

Further referring to FIG. 2, the downhole system houses all electronic assemblies and subassemblies, and is responsible for gathering data from sensors near the drilling bit, and subsequently transmitting this data from depths as great as 15,000+feet to the surface. The major components of the downhole system include a downhole mechanical assembly, an electronics unit, a downhole digital power amplifier, and various other elements (not shown).

In more specific terms, the downhole system includes internal sensors 60, a sensor assembly 62, an A/D converter 54, a microprocessor 58, a modulator 56, a pressure transducer 66, an on/off control unit 53, the downhole digital power amplifier 68, and a battery pack 70.

In operation, drill bit, environmental or formation data are supplied to the A/D converter 54 by a variety of sensors 60 and 62 located throughout the drill-string. Upon receipt of a pressure pulse command from pressure transducers 66, or upon expiration of a time-out procedure, whichever is selected, the electronics unit (that is, the A/D converter 54, microprocessor 58 and modulator 56) powers up to obtain the latest data from the sensors 60 and 62, and begins transmitting the data to the power amplifier 68 (which is preferably located in the upper portion of the mechanical assembly of the drill-string).

Operational data from the electronics unit (the A/D converter 54, microprocessor 58 and modulator 56) is sent to the downhole digital power amplifier 68, and this establishes the frequency, power and phase output of the data. The data is then shifted into the power amplifier 68, and the power amplifier output is coupled to the drill string by conventional means in order to provide transmission of the data to the uphole receiver 72.

It is to be noted that the electronics unit (A/D converter 54, microprocessor 58 and modulator 56) and the downhole digital power amplifier 68 are powered by a battery pack 70, including nickel-cadmium batteries configured to provide proper operating voltage and current. The signal transmitted to the uphole receiver 72 is in the form of an electro-magnetic wave front traveling through the earth, the wave eventually penetrating the earth's surface and being picked up by conventional signal pickup assembly 76 included within the uphole receiver system 72. For example, the uphole receiver 72 may include radial receiving arms located around, but not in contact with, the drilling platform. These arms intercept the electromagnetic wave front and feed the corresponding signal to a receiver electronics unit (not shown) which filters and cancels any extraneous noise which has been picked up during transmission, and as well amplifies the corresponding signal and sends it to a low-level receiver (also not shown). The latter receiver is a conventional receiver, but can be specially designed so as to be capable of synchronizing to the upcoming frequency, receiving extremely low-level signals, determining phase relationship of the signal, rejecting additional noise, and formatting the data into a TTL output suitable for process or input.

The uphole receiver system 72 can also be provided with a conventional processor/display assembly 80 which receives the raw data TTL output from the receiver, performs any necessary calculations and error corrections, and displays the data in a usable format on a CRT screen.

Downhole Digital Power Amplifier

The downhole system, as previously mentioned, includes a downhole electronics assembly which may be a two-foot long cylinder containing the hardware necessary to process external sensor data and to provide a serial data stream (modulated signal) for transmission to the uphole receiver 72. The electronics assembly may be externally powered by NICAD batteries, as previously mentioned. The assembly may, in addition, be housed in a downhole pressure tube, and may be shock-mounted at the top and the bottom so as to prevent disturbance of the internal electronic circuitry. The major subassemblies of the downhole electronics assembly include microprocessor 58, internal sensors 60, A/D converter 54, pressure transducer 66, and on/off control unit 53.

The downhole electronics assembly is functionally a single-thread microprocessor-based data collection and transmission unit. The principal functional requirement to be carried out is the sampling of the internal and external sensors 60 and 62, respectively and the conversion of the analog and parallel digital data into a single serial modulated bit stream. The final step is to amplify the bit stream and provide it for transmission to the uphole receiver 72.

The high power-consuming elements are turned on by a series of pressure commands transmitted through the downflow mud from the surface, such commands being sensed by a pressure transducer or sensor. Alternatively turn on can be achieved by a preset timer. However, the electronics package is intended to be normally in the semiquiescent mode, with power on only to the microprocessor memory and clock.

In addition to the directional data, the downhole electronics assembly also incorporates a number of self-test and house-keeping sensors. Functionally, the downhole electronics assembly accepts electrical signals from the external sensor assembly 62, processes them, along with internal house-keeping data, to form a serial binary data stream, and modulates a precisely-derived carrier frequency which is then amplified for external transmission. The assembly, as previously mentioned, contains a special mud-pressure transducer 66 and associated circuitry to receive commands through which specific data may be requested and transmitted to the uphole receiver 72.

All signal lines are time-multiplexed and converted from analog to digital with 12-bit resolution. The serial-bit-data string consists of 50 cycles of unmodulated carrier, followed by a 2 bit sync code and sequence verifier of 6 bits. Each dataword is 13 bits in length (the most significant bit is an overrange indicator) with bi-phase modulation performed at a rate ($R_n$) consistent with carrier frequencies ($f_c$) as follows:

| $f_c$ | $R_n$ |
|---|---|
| 2.5 Hz. | 1 BPS |
| 5 Hz. | 2 BPS |
| 10 Hz. | 4 BPS |
| 20 Hz. | 8 BPS |

The modulation rate is controlled by the microprocessor 58 consistent with the carrier frequency selection.

Moreover, the microprocessor 58 is programmable by use of PROM's such that overall control and sequencing may be easily changed. All sequences will be in response to mud-pressure commands or a preset timer.

The downhole digital power amplifier 68 receives data from the electronics portion (A/D converter 54, microprocessor 58 and modulator 56) of the downhole system, and acts upon that data to furnish a modulated signal for transmission to the uphole receiver 72. The power amplifier 68 contains, as will be seen below, a bi-phase modulator and a dead man timer, in addition to the actual power amplifier circuitry. The frequency output and modulation are controlled completely by digital signals, as explained below.

FIG. 4 is a detailed block diagram of the downhole digital power amplifier 68 contained in the downhole system of FIG. 2. As seen in FIG. 4, the downhole digital power amplifier 68 includes shift register 81, a programmable frequency divider 82, a dead man timer 84, a counter 86, a sync circuit 88, a PROM (programmable read-only memory) 90, a digital-to-analog converter (DAC) 92, a power supply control circuit 94, and analog divide-by-N circuit 96, and a power amplifier 98.

The power amplifier 68 of FIG. 4 also includes a bi-phase modulator made up of PROM 90 and DAC 92. As previously mentioned, frequency, power output and modulation are controlled completely by digital signals, as will now be explained.

To set the frequency and power output, a 16-bit word CMDD is shifted into the shift register 81. Each bit is shifted in by placing data on the CMDD line and creating a rising edge on the STROBE line, the latter strobing the data into the register 81. The first eight bits determine the power output and the last eight bits determine the frequency. Multiple frequencies may be obtained via a programmable frequency divider 82 connected to the output of the 16-bit shift register 81.

As further seen in FIG. 4, the output of the divider 82 is provided to an 8-bit counter 86, the latter driving the PROM 90. The PROM contains two sine tables, one for the positive part of a sine wave, and the other for the negative part of the sine wave.

FIG. 5 is a graphical representation of a sine wave, and relates the particular portion (positive or negative) of the sine wave to the contents of the PROM 90 of FIG. 4. The arrangement of the PROM 90 allows the most significant bit to control whether a positive or negative half sine is to be generated when the counter goes from 0 to 127 (the binary equivalent). Thus, a most significant bit of 0 indicates the positive portion of the sine wave, while a most significant bit of 1 indicates the negative portion of the sine wave. This bit must of course be changed only when the counter 86 arrives at 0, and the sync circuit 88 makes sure that this is the case. That is to say, the sync circuit 88 generates a FLAG signal, the inverse of which indicates when the CMDD line can be changed. When the counter 86 goes to 0 (from 127), the state of the CMDD line is latched and is held until the next count of 0.

The power output of the downhole digital power amplifier is set by running the output of DAC 92 into a programmable analog divider 96 which is controlled by the first eight bits from the 16-bit shift register 81. A division of 1/255 of the maximum power out can be obtained in this manner. If power out can be measured by the processor controlling the power amplifier 98, the output power can be held at a relatively constant level, even if the load impedance changes.

As will also be shown in more detail below, modulation is selected, in the downhole digital power amplifier 68, by the combined operation of the 8-bit counter 86 and the sync circuit 88.

The dead man timer (DMT) circuit 84 is used to sense a "lack of control" or abnormal (fault) condition. If the CMDD lines does not change state periodically, the "lack of control" or fault condition is indicated. The circuit 84 will "time out" and cause a string of zeros to be provided as an output by the power amplifier 98 for about 30 seconds to indicate that the "lack of control" or fault condition exists. The DMT 84 will then wait for 15 minutes or so, and then cause the message to be sent once again, continuing the procedure until the CMDD line indicates normal operation (changes state). During nontransmission times, power is cut off to most of the circuitry and elements of the downhole system 60 (FIG. 1) by the combined operation of the dead man timer 84 and power supply control 94.

The power supply control circuit 94 selectively responds to either the DMT circuit 84 or the KEY input (an input which tells the downhole amplifier 68 that data is coming, and that it is time to "power up" all circuits and devices). That is to say, the power supply control circuit 94 permits power to be removed from all circuitry, except the shift register 81 and the DMT circuit 84, when data is not being provided to the downhole power amplifier 68, and allows power to be applied to that circuitry when reception of data by the downhole digital power amplifier 68 is imminent. As a result of this feature, significant savings in battery life within the downhole system is achieved by elimination of the application of power to unnecessary devices during certain times, thus preventing current drain on the battery pack 70. (FIG. 2) and lengthening the life of the battery pack 70. Replacement of the battery pack 70 more frequently necessarily involves more frequent need to raise the drill string of the drilling system, thus involving significant loss in drilling time and significant expense.

Finally, with respect to the power supply control 94, it is to be noted that the input from the DMT 84 overrides the KEY input in the case of conflict therebetween. In addition, as previously mentioned, and as will be discussed in more detail below, power supply control 94 may be controlled selectively by either the KEYB input or the dead man timer 84 itself.

FIG. 6 is a detailed schematic of the dead man timer circuit 84 of FIG. 4. As seen therein, the dead man timer circuit 84 comprises monostable multivibrator 110 and astable multivibrator device 112, and associated resistors and capacitors, as well as NOR gates 114 and 116 connected as shown. The multivibrator 110 and astable multivibrator device 112 are CD4528BM and 7555 devices, respectively, manufactured by Radio Corporation of America and Intersil Inc., respectively.

In normal operation, the CMDD input is a variable bit stream which is provided to the dead man timer circuit 84, and specifically to the 1A input of the monostable multivibrator 110. The monostable multivibrator 110 responds to the transitions in the CMDD input by setting the inverted 1Q output low. This low output resets the astable multivibrator device 112 so that OUT goes (and stays) low. Since NOR gates 114 and 116 will each have one input low, KEYB will control the power supply control circuit 94 via PWRON. Therefore, when KEYB is high (that is, when data reception is imminent), the power supply control circuit 94 will "power up" all of the circuitry of the downhole digital power amplifier 68. Conversely, when KEYB is low ("no data" condition), only necessary electronics will be "powered up". In either event, the inverted 1Q output to sync circuit 88 will remain low for reasons to be explained below.

In the abnormal or "fault" condition, CMDD is lost (constantly low or high) and the inverted 1Q output of multivibrator 110 is high. Thus, astable multivibrator device 112 is not reset and NOR gate 114 has a low output. This blocks KEYB from controlling PWRON, turning control over to the astable multivibrator device 112 instead. As a result of the operation of astable multivibrator 112, OUT goes low for 15–30 seconds at a time, and then returns to a high state for approximately 15 minutes. The result is that the downhole digital power amplifier 68 periodically sends a "fault informant" message to the surface.

FIG. 7 is a detailed schematic of the sync circuit 88 of FIG. 4. As seen therein, sync circuit 88 comprises D-type flip-flop 120, AND gates 122 and 124, inverter 126, NOR gate 128 and D-type flip-flop 129.

In operation, when the 8-bit counter 86 experiences a zero state, flip-flop 120 is clocked so as to cause a Q output to be provided to the PROM 90 (FIG. 4) and to AND gate 122, the other input of which receives the inverted output of dead man timer 84. The inverted 1Q output 1Q of dead man timer 84 is also provided (via inverter 126) to AND gate 124, the other input of which receives input CMDD (corresponding to the serial data bit stream provided to the register 80 in FIG. 4).

AND gates 122 and 124 are connected, with converter 126 and NOR gate 128, in such a configuration that, under normal operational conditions (inverted 1Q low), CMDD controls the setting of flip-flop 120 (via a feedback loop), while, under "fault" conditions (inverted 1Q high), the Q output of flip-flop 120 controls the flip-flop 120 (via the feedback loop). More specifically, when inverted 1Q goes low, AND gate 122 issues a low output and AND gate 124 has an output of CMDD; therefore, NOR gate 128 has an output of inverted CMDD. Conversely, when inverted 1Q goes high, AND gate 124 has a low output and the output of AND gate 122 is Q, so that the output of NOR gate 128 is inverted Q. In the first instance, inverted CMDD controls the setting/resetting of flip-flop 120, which is clocked by ZERO from 8-bit counter 86 (FIG. 5) when the counter 86 reaches a zero state. In the second instance, the flip-flop 120 is configured as a divide-by-two circuit.

The flip-flop 129 generates FLAG which tells the microprocessor 58 (FIG. 2) that a zero count in counter 86 (FIG. 4) is approaching. More specifically, $Q_D$ is the most significant bit and $Q_A$ the third most significant bit in the counter 86. With $Q_D$ low, the flip-flop 129 is cleared. When $Q_A$ and $Q_D$ are both high, Q goes high and FLAG is "on". When $Q_A$ goes low and $Q_D$ stays high, nothing happens. Finally, when $Q_A$ and $Q_D$ are both low (at zero count), Q goes low and FLAG is off.

FIG. 8 is a detailed schematic of the power supply control circuit 94 of FIG. 4. As seen therein, power supply control circuit 94 includes resistor 130, NPN transistor 132, PNP transistor 134, zener diodes 136 and 138, PNP transistor 140, and NPN transistor 142, connected as shown.

In operation, when PWRON (generated by the dead man timer 84) goes high, indicating that all electronic elements of the downhole digital power amplifier 68 (FIG. 4) are to be "powered up", transistors 132, 134, 140 and 142 are all turned on. This causes the +12 VS, −12 VS and +5 VS, respectively, to be supplied to appropriate elements of the downhole digital power amplifier 68.

However, once PWRON goes low, transistors 132, 134, 140 and 142 turn off, and power supply to the various elements of the downhole digital power amplifier 68 ceases.

In describing the invention, reference has been made to a preferred embodiment and illustrative advantages of the invention. Those skilled in the art, however, and familiar with the instant disclosure of the subject invention, may recognize additions, deletions, modification, substitutions and/or other changes which will fall within the purview of the subject invention and claims.

We claim:

1. A downhole digital power amplifier for use in downhole telemetry applications, wherein the downhole digital power amplifier has the capability of selecting frequency, power and modulation modes, said downhole digital power amplifier comprising:

digital input means for selecting at least one of frequency and power, and for additionally selecting a modulation mode of the downhole digital power amplifier;

generating means for generating a sinusoidal output characterized by said selected at least one of said frequency and power, and modulated in accordance with said selected modulation mode; and transmitting means for transmitting said generated sinusoidal output from the downhole digital power amplifier through the earth to the earth's surface.

2. The downhole digital power amplifier for use in downhole telemetry applications as defined in claim 1, wherein:

frequency is selected and a digital bit stream is provided to said digital input means, said digital input means comprising a shift register having a plurality of bits for indicating said selected frequency.

3. The downhole digital power amplifier for use in downhole telemetry applications as defined in claim 1, wherein:

power is selected and a digital bit stream is provided to said digital input means, said digital input means comprising a shift register having a plurality of bits for indicating said selected power.

4. The downhole digital power amplifier for use in downhole telemetry applications as defined in claim 1, wherein:

a digital bit stream is provided to said digital input means, said digital input means comprising a shift register;

said digital input means comprising means for providing a clock signal, and a programmable frequency divider for receiving and frequency-dividing said clock signal in accordance with a frequency-indicating portion of said digital bit stream so as to develop a frequency divider output;

said digital input means further comprising a counter responsive to said frequency divider output from said programmable frequency divider for counting in accordance therewith, said counter counting to a zero state and issuing a corresponding zero output;

said digital input means further comprising a sync circuit responsive to said zero output from said counter for issuing a corresponding output; and said operating means comprising a programmable read-only memory for issuing digital outputs corresponding in value to successive amplitude values of a sinusoidal waveform, said programmable read-only memory being responsive to said corresponding output of said sync circuit for changing from a positive-going portion of said sinusoidal waveform to a negative-going portion of said sinusoidal waveform only when said counter has achieved said zero state.

5. The downhole digital power amplifier for use in downhole telemetry applications as defined in claim 4, said generating means further comprising:

a digital-to-analog converter connected to said programmable read-only memory for receiving and converting said digital outputs to analog form so as to provide a corresponding analog output; and an analog divider responsive to said corresponding analog output of said digital-to-analog converter and to a further portion of said digital bit stream for dividing said analog output to produce an analog divided output comprising said sinusoidal output;

said transmitting means comprising a power amplifier for receiving said analog divided output and responsive thereto for issuing an amplified output for transmission to the earths surface.

6. The downhole digital power amplifier for use in downhole telemetry applications as defined in claim 1 and further comprising:

detecting means for detecting a fault condition and responsive thereto for periodically generating a failure informant signal for transmission

7. The downhole digital power amplifier for use in downhole telemetry applications as defined in claim 6, wherein:

said detecting means comprises a dead man timer circuit for receiving a digital input and responsive thereto for detecting normal operation or a fault condition of said downhole digital power amplifier, and responsive to detection of said fault condition for generating a power-off signal of a first duration periodically interrupted by a power-on signal of a relatively small second duration; and a power supply control circuit responsive to said power-on signal and said power-off signal for applying and not applying, respectively, power to said generating means, whereby to generate said failure informant signal.

8. The downhole digital power amplifier for use in downhole telemetry applications as defined in claim 7, wherein:

said dead man timer circuit receives a further digital input indicating when reception of said digital input is to be expected, said dead man timer circuit being responsive to detection of said normal operation for generating said power-off signal when reception of said digital input is not expected and for generating said power-on signal when reception of said digital input is expected.

9. The downhole digital power amplifier for use in downhole telemetry applications as defined in claim 4, wherein said sync circuit comprises a D-type flip-flop having a data input, a clock input for receiving said zero output from said counter, and a Q output for issuing said corresponding output, said data input being connected to selector means for selecting the digital bit stream under normal, non-fault conditions of operation of the downhole digital power amplifier, and for selecting the Q output of the D-type flip-flop under abnormal, fault conditions of operation of the downhole digital power amplifier, whereby setting/resetting of the D-type flip-flop is controlled by the digital bit stream and the zero output of the counter under normal conditions, and the D-type flip-flop functions as a divide-by-two circuit in response to the zero output of the counter under fault conditions.

10. A digital power amplifier for use in telemetry applications, wherein the downhole digital power amplifier has the capability of selecting frequency, power and modulation modes, said downhole digital power amplifier comprising:

digital input means for selecting at least one of frequency and power, and for additionally selecting a modulation mode of the digital power amplifier; and generating means for generating a sinusoidal output characterized by said selected at least one of said frequency and power, and modulated in accordance with said selected modulation mode.

11. The digital power amplifier for use in telemetry applications as defined in claim 10, wherein frequency is selected and a digital bit stream is provided to said digital input means, said digital input means comprising a shift register having a plurality of bits for indicating said selected frequency.

12. The digital power amplifier for use in telemetry applications as defined in claim 10, wherein power is selected and a digital bit stream is provided to said digital input means, said digital input means comprising a shift register having a plurality of bits for indicating said selected power.

13. The digital power amplifier for use in telemetry applications as defined in claim 10, wherein:

a digital bit stream is provided to said digital input means, said digital input means comprising a shift register;

said digital input means comprising means for providing a clock signal, and a programmable frequency divider for receiving and frequency-dividing said clock signal in accordance with a frequency-indicating portion of said digital bit stream so as to develop a frequency divider output;

said digital input means further comprising a counter responsive to said frequency divider output from said programmable frequency divider for counting in accordance therewith, said counter counting to a zero state and issuing a corresponding zero output;

said digital input means further comprising a sync circuit responsive to said zero output from said counter for issuing a corresponding output; and said generating means comprising a programmable read-only memory for issuing digital outputs corresponding in value to successive amplitude values of a sinusoidal waveform, said programmable read-only memory being responsive to said corresponding output of said sync circuit for changing from a positive-going portion of said sinusoidal waveform to a negative-going portion of said sinusoidal waveform only when said counter has achieved said zero state.

14. The digital power amplifier for use in telemetry applications as defined in claim 10, wherein said sync circuit comprises a D-type flip-flop having a data input, a clock input for receiving said zero output from said counter, and a Q output for issuing said corresponding output, said data input being connected to selector means for selecting the digital bit stream under normal, non-fault conditions of operation of the digital power amplifier, and for selecting the Q output of the D-type flip-flop under abnormal, fault conditions of operation of the digital power amplifier, whereby setting/resetting of the D-type flip-flop is controlled by the digital bit stream and the zero output of the counter under normal conditions, and the D-type flip-flop functions as a divide-by-two circuit in response to the zero output of the counter under fault conditions.

15. The digital power amplifier for use in telemetry applications as defined in claim 13, said generating means further comprising:

a digital-to-analog converter connected to said programmable read-only memory for receiving and converting said digital outputs to analog form so to provide a corresponding analog output;

an annalog divider responsive to said corresponding analog output of said digital-to-analog coverter and to a further portion of said digital bit stream for dividing said analog output to produce an analog divided output; and a power amplifier for receiving said analog divided output and responsive thereto for issuing an amplified output comprising said sinusoidal output.

16. The digital power amplifier for use in telemetry applications as defined in claim 10, further comprising:

detecting means for detecting a fault condition and responsive thereto for periodically generating a failure informant signal for transmission.

17. The digital power amplifier for use in telemetry applications as defined in claim 16, wherein:

said detecting means comprises a dead man timer circuit for receiving a digital input and responsive thereto for detecting normal operation or a fault condition of said digital power amplifier, and responsive to detection of said fault condition for generating a power-off signal of a first duration periodically interrupted by a power-on signal of a relatively small second duration; and a power supply control circuit responsive to said power-on signal and said power-off signal for applying and not applying, respectively, power to said generating means, whereby to generate said failure informant signal.

18. The digital power amplifier for use in telemetry applications as defined in claim 17, wherein:

said dead man timer circuit receives a further digital input indicating when reception of said digital input is to be expected, said dead man timer circuit being responsive to detection of said normal operation for generating said power-off signal when reception of said digital input is not expected and for generating said power-on signal when reception of said digital input is expected.

* * * * *